US006454127B1

(12) United States Patent
Suomela et al.

(10) Patent No.: US 6,454,127 B1
(45) Date of Patent: Sep. 24, 2002

(54) SELF-CONTAINED LIQUID DISPENSER WITH HEATING MEANS

(76) Inventors: Sheree Suomela, 6316 Valley View Rd., Edina, MN (US) 55436; Paul Anderson, 7440 Edinborough Way, #4319, Edina, MN (US) 55435; William R. Worrell, 148 Interlocken Rd., Hopkins, MN (US) 55343; Patty S. Anderson, 7440 Edinborough Way, #4319, Edina, MN (US) 55435; Peter B. Allard, 3575 Larchwood Dr., Minnetonka, MN (US) 55345; Robert J. Marks, 4664 Hillsboro Ave., New Hope, MN (US) 55428

( * ) Notice: Subject to any disclaimer, the term of this patent is extended or adjusted under 35 U.S.C. 154(b) by 0 days.

(21) Appl. No.: 09/641,280

(22) Filed: Aug. 17, 2000

(51) Int. Cl.[7] ..... B67D 5/62

(52) U.S. Cl. ..... 222/54; 222/638; 222/146.5; 222/321.7

(58) Field of Search ..... 222/54, 638, 146.5, 222/321.7, 321.9

(56) References Cited

U.S. PATENT DOCUMENTS

| | | | | |
|---|---|---|---|---|
| 1,158,586 A | | 11/1915 | Thornton, Jr. | |
| 1,482,088 A | | 1/1924 | Mitscherling | |
| 1,551,173 A | | 8/1925 | Royce et al. | |
| 1,654,842 A | | 1/1928 | Smith et al. | |
| 1,673,567 A | | 6/1928 | Hynes | |
| 1,806,004 A | | 5/1931 | Tavender | |
| 2,090,666 A | | 8/1937 | Copeland et al. | 219/45 |
| 2,292,992 A | | 8/1942 | Crouch | 219/45 |
| 2,415,060 A | | 1/1947 | Craig | 230/170 |
| 2,762,901 A | | 9/1956 | Liedberg | 219/39 |
| 3,056,553 A | | 10/1962 | Hazen et al. | 236/3 |
| 3,144,174 A | | 8/1964 | Abplanalp | 222/146 |
| 3,266,674 A | | 8/1966 | Martin | 222/146 |
| 3,430,816 A | * | 3/1969 | Nadherny et al. | 222/146.5 |
| 3,432,641 A | | 3/1969 | Welke | 219/433 |
| 3,644,702 A | | 2/1972 | Kohler | 219/201 |
| 3,741,441 A | | 6/1973 | Eberle | 222/135 |
| 3,896,973 A | | 7/1975 | Morgan | 222/146.5 |
| 3,997,083 A | | 12/1976 | McNair | 222/146.5 |
| 4,024,854 A | | 5/1977 | Park et al. | 126/343.5 A |
| 4,055,279 A | | 10/1977 | Lapera et al. | 222/54 |
| 4,136,721 A | | 1/1979 | Holmqvist | 141/11 |
| 4,269,147 A | | 5/1981 | Vorbeck | 119/73 |
| 4,544,085 A | * | 10/1985 | Frazer | 222/146.5 |
| 4,661,684 A | | 4/1987 | Sellers | 219/279 |
| 4,762,060 A | | 8/1988 | Santa Cruz | 99/483 |
| 4,790,455 A | | 12/1988 | Dieringer et al. | 222/146.2 |
| 4,790,730 A | | 12/1988 | Spaeth et al. | 417/373 |
| 4,847,470 A | | 7/1989 | Bakke | |
| 4,848,420 A | | 7/1989 | Claassen | 141/82 |

(List continued on next page.)

FOREIGN PATENT DOCUMENTS

| | | |
|---|---|---|
| WO | WO 99/51947 | 10/1999 |

*Primary Examiner*—Joseph A. Kaufman
(74) *Attorney, Agent, or Firm*—Dorsey & Whitney LLP

(57) ABSTRACT

A portable liquid heating and dispensing system is provided. A preferred embodiment includes a self-contained dispensing unit and a receiver. The dispensing unit may include a container portion, a dispensing portion, and an electric heat generating portion. The container portion has a main reservoir for holding a supply of the liquid to be dispensed. The dispensing portion has a down tube, a manually operated pump mechanism connected to the down-tube, and an outlet spout connected to the pump mechanism. The pump mechanism has a liquid reservoir. Liquid is drawn through the down tube and into the liquid reservoir and out of the outlet spout. The heat generating portion is positioned at the liquid reservoir, so that liquid pumped out of the main reservoir is heated before being pumped out of the spout. The receiver accepts and provides power to the self-contained dispensing unit.

11 Claims, 13 Drawing Sheets

U.S. PATENT DOCUMENTS

| | | | | | |
|---|---|---|---|---|---|
| 4,941,597 | A | * | 7/1990 | Lopez et al. | 222/146.5 |
| 5,016,790 | A | | 5/1991 | Thomas et al. | 222/639 |
| 5,040,700 | A | * | 8/1991 | Compton | 222/146.5 |
| 5,091,095 | A | * | 2/1992 | Fries et al. | 222/54 |
| 5,111,969 | A | * | 5/1992 | Knepler | 222/54 |
| 5,125,757 | A | | 6/1992 | Morrison et al. | 401/21 |
| 5,208,896 | A | | 5/1993 | Katayev | 392/444 |
| 5,242,133 | A | | 9/1993 | Zwick | 244/134 C |
| 5,248,870 | A | | 9/1993 | Redal | 219/521 |
| 5,397,875 | A | | 3/1995 | Bechtold, Jr. | 219/521 |
| 5,636,922 | A | | 6/1997 | Clark | 366/145 |
| 5,716,199 | A | | 2/1998 | Shan-Chich | 417/312 |
| 5,842,605 | A | | 12/1998 | Lehmkuhl | 222/95 |
| 5,858,248 | A | | 1/1999 | Plester et al. | 210/709 |
| D426,413 | S | | 6/2000 | Kreitemier et al. | |
| 6,216,911 | B1 | | 4/2001 | Kreitemier et al. | |

* cited by examiner

SELF-CONTAINED LIQUID DISPENSER WITH HEATING MEANS

BACKGROUND OF THE INVENTION

1. Field of the Invention

This invention relates to devices for dispensing liquids and more particularly to self-contained dispensing units where the liquid in such devices is warmed before dispensing.

2. Background of the Invention

Dispensing pre-heated liquids is essential or desirable in many applications. Applications in which the capability of efficiently and economically dispensing pre-heated liquid in portable hand held containers would be desirable include cosmetic, therapeutic, and food service industries. Typical prior art devices for heating such hand held containers have heating elements on the bottom or sides of a container which contains the liquid product to be heated and dispensed. Typically these prior art devices include a heating element which is inserted into the fluid in the container portion or heating means external to the container portion. Others contain a heating element which is fixed within the container portion. However, these prior art devices heat the entire contents of the container to desired temperature. The methodology of heating the entire contents of a container is inefficient in that energy is wasted when a portion of the liquid substance is heated, yet not dispensed. A container of this nature is also inefficient in that the time necessary to warm the entire liquid contents to the desired temperature will be in excess of the time required to warm only the portion of the liquid to be dispensed. Such prior art devices are further inefficient in that perishable contents may be degraded prematurely by being repeatedly heated and cooled before being dispensed. The present invention substantially meets the aforementioned needs by providing a liquid dispenser that efficiently heats substantially only the portion of the liquid to be dispensed. The present invention further meets the aforementioned needs by providing a liquid dispenser that can quickly heat the liquid to be dispensed. The present invention yet further meets the aforementioned needs industry by minimizing the necessity of heating and reheating liquid contents, thereby minimizing degradation and maximizing potential shelf life of the liquid. These and other advantages will become apparent as the invention is more fully illustrated and described hereinbelow.

SUMMARY OF THE INVENTION

A portable liquid heating system for heating and dispensing a liquid has a self-contained dispensing unit attachable to a receiver and is particularly suitable for dispensing lotion. The dispensing unit includes a dispensing portion with a pump mechanism, and a container portion. The pump mechanism comprises a pump mechanism reservoir, a draw tube, an inlet valve, a pump handle including a spout, and a piston in a cylinder. The container portion comprises a main liquid reservoir and a threaded neck portion. A nut attaches the dispensing portion to the neck portion. Heating of dispensed liquid is accomplished by providing heat directly or indirectly to the liquid in the dispensing portion, for example by providing heat to specific portions of the pump mechanism whereby the liquid therein or the liquid passing therethrough is heated by conduction. The heating can be provided by heating elements in the pump mechanism liquid reservoir such that a heating element is immersed or partially immersed in the liquid therein. Power may be provided to such a heating element by the receiver configured as a stand with a power connection means. Said connection means may comprise direct electrical connection to contacts on the pump mechanism by an electric power source with contacts on the stand. Alternative power connection means may comprise a coil on the stand which couples with a cooperating coil on the pump apparatus. The cooperating coil may be part of, or connect to, the heating element positioned at the pump mechanism.

Components of the pump mechanism, such as the pump mechanism reservoir or the draw tube can be formed of conductive and resistive material that heats when subjected to a current. Alternatively, a separate heating attachment for thermal conductive contact with the exterior of the pumping mechanism may be utilized. The heating attachment may have a direct wired connection to a power source or may have connection means as described above. Such a separate heating attachment can be clamped or slipped onto existing dispensing portions.

Alternative embodiments of the invention may utilize heating means with nonelectric heating sources such as hot water running through a shower outlet. The hot water may be circulated through portions of the liquid pump apparatus or the heat from the shower outlet may be conductively transferred through a thermal conduit to the liquid pump apparatus.

In particular embodiments, the system may utilize control circuitry in the pump mechanism, the stand, and/or the heating attachment. Such circuitry can include a thermostatic control, timer controls, presence sensing of the fluid pump apparatus in the receiver, presence sensing of fluid in a specific location, i.e., the fluid pump mechanism liquid reservoir, and the like.

In particular embodiments, the dispensing portion may have energy storage elements therein such as rechargeable batteries or heat sinks that provide and/or retain power or heat for a period of time after the dispensing portion (or unit) is removed from the receiver.

Thus, the present invention provides an apparatus and a method for quickly, efficiently, and economically warming a liquid to be dispensed from a container. In that only the portion of the liquid to be dispensed is warmed, the energy and time required to warm the liquid to the desired temperature are minimized. Moreover, because reheating is largely eliminated, the shelf life of many liquids may be enhanced.

DETAILED DESCRIPTION OF THE PREFERRED EMBODIMENTS

Figure 1:
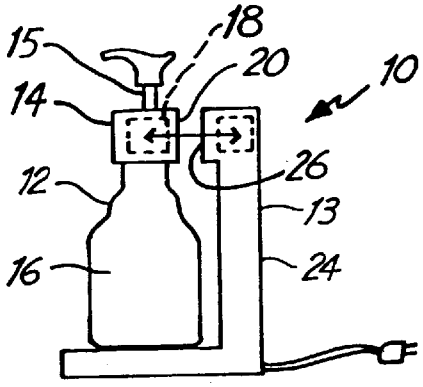
FIG. 1 is a side elevational view depicting principal components of the present portable liquid heating and dispensing system.

Referring to FIG. 1, the principal components of the portable liquid heating and dispensing system 10 are a self-contained dispensing unit 12 and a receiver 13. The self-contained dispensing unit 12 comprises a dispensing portion 14 with a pump mechanism 15, a container portion 16, the heating portion 18, and a connection means 20. The receiver 13 has a stand portion 24 and a cooperating connection means 26. The connection means may be by direct electrical contacts, inductive contacts, or thermal conductive contact, or by way of a heated media, for example water, all of which are discussed below.

Figure 2A:
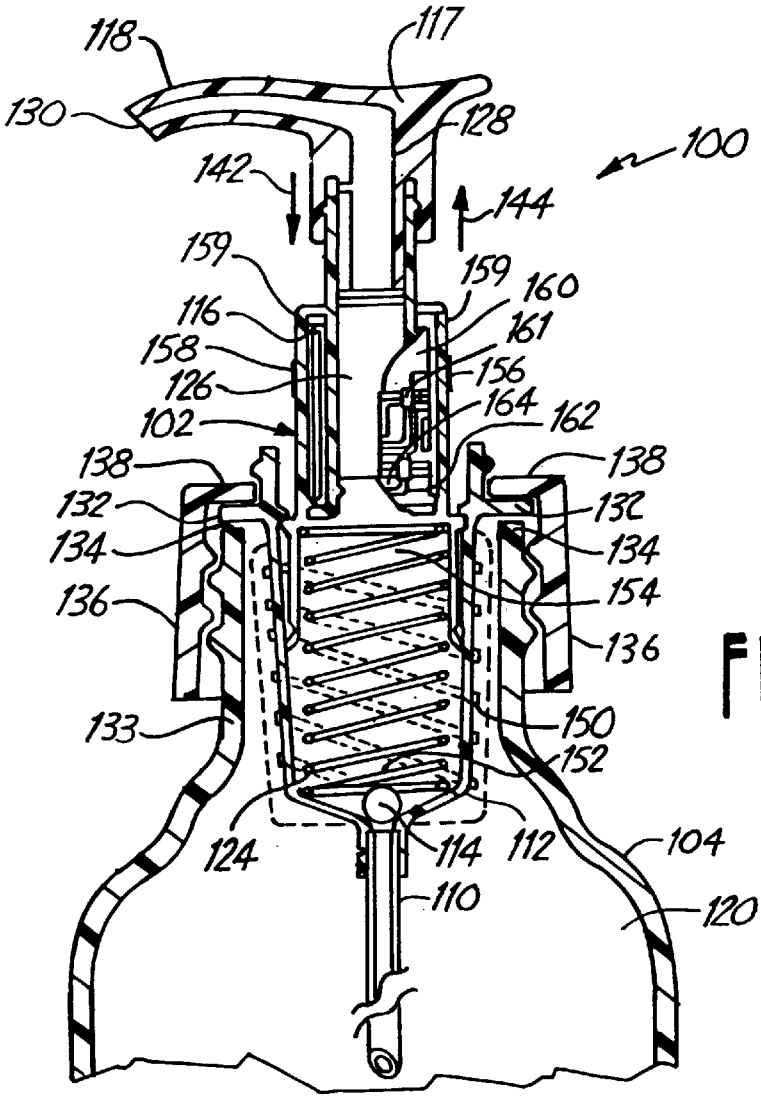
FIG. 2*a* is a fragmentary cross-sectional view of a first embodiment of the present heating and dispensing portion.

Referring to FIG. 2*a*, a specific embodiment of a dispensing portion 100 has a pump mechanism 102, that includes a draw tube or down tube 110, a pump mechanism fluid reservoir 112, an inlet valve 114, a plunger 116, and a push handle 117 that includes a spout 118. The various embodiments of liquid pumps of this nature, as well as how these parts cooperate, are known to the art. However, the operation of the liquid pump will be briefly described. The draw tube 110 defines a flow conduit, extends into a liquid 120 to be dispensed by the pump, and is attached to the pump mechanism reservoir 112 by a liquid-tight connection. The inlet valve 114 allows liquid to be drawn into the pump reservoir 112, but prevents the liquid from flowing from the pump mechanism fluid reservoir back into the container portion 104. The plunger 116 is slidably positioned within the reservoir 112 and is biased proximate an upper portion of the reservoir 112 by a helical spring 124. A passage 126 in the plunger 116 opens into the reservoir 112 and communicates with a passage 128 in the outlet spout 118. The spout passage 128 terminates in an opening 130. A lip 132 extends around an upper portion of the reservoir 112 in this embodiment. The pump mechanism 102 is positioned in the container 104 as depicted in FIG. 1 such that the lip 132 rests atop the container neck 134 when the container 104 is in an upright position. The pump mechanism 102 is fixed in place by securing a threaded cap 136 about the container neck 133 as shown. A cap flange 138 presses against the lip 132 as the cap 136 is threaded in place. The liquid 120 is dispensed by pressing the spout down in the direction of the arrow 142.

Pressing the spout down as indicated displaces the plunger 116 into the reservoir 112, thereby forcing the liquid present in the reservoir 112 through the passages 126 and 128 and out the opening 130. As the plunger 116 is forced into the reservoir 112, the inlet valve 114 in the reservoir becomes seated against the draw tube 110 to prevent the liquid within the reservoir 112 from being forced down through the draw tube 110 and back into the container 104. When the liquid within the reservoir 112 has been dispensed, the spring 124 is allowed to return the plunger 116 to a position atop the reservoir 112. When the reservoir 112 is being returned by the spring 124, a suction is created within the reservoir 112. The suction draws the liquid 120 from the container 104 into the reservoir 112 to replenish the liquid within the reservoir 112, which is available to be dispensed.

An electric heat generating portion configured as heating element wire 150 is wound about an exterior of the reservoir 112 in this embodiment. Isolating or insulative material may enclose or encapsulate the heating element 150. One or more of temperature sensors 152 and 154 are also disposed on an exterior portion of the reservoir 112. In another embodiment, the sensors sense the presence of the liquid and close heating circuits in response thereto. Electrical contacts 156 and 158 are present on an extension 159 outside the plunger 116 and are connected to the circuit 160. The circuit 160 includes a flexible lead 162 electrically communicating the circuit 160 to the heating element 150. Another flexible lead 164 connects the temperature sensors 152 and 154 to the circuit 160. When unheated liquid is drawn into the reservoir 112, the lower temperature of the unheated liquid is sensed by the temperature sensors 152 and 154 and the sensing is conveyed to the circuit 160. The circuit 160 includes a switch 161 to send current through the heating element 150. The heating element 150 then heats the liquid 120 present in the reservoir 112 to a desired temperature or to within a desired temperature range. When the liquid in the reservoir 112 is at the desired temperature, the sensors 152 and 154 convey the sensing to the circuitry 160. The circuitry 160 then opens the switch 161 to disconnect the electrical current to the heating element 150. Alternatively, the switch may modulate the current to the heating element rather than on-off switching. The circuitry 160 may also include a timer to either heat the fluid for a predetermined time period and/or discontinue heating when the fluid has remained in the reservoir for a predetermined period of time. The electrical contacts 156 and 158 connect the heating system to a source of direct current in this embodiment. Also in this embodiment, the circuitry 160 determines a temperature difference between incoming and outgoing liquid to adjust the current, and thus the heating, based on the temperature difference. In this and other embodiments of this invention, the spring 124 or an equivalent structure may also function as a heating element.

Figure 2B:
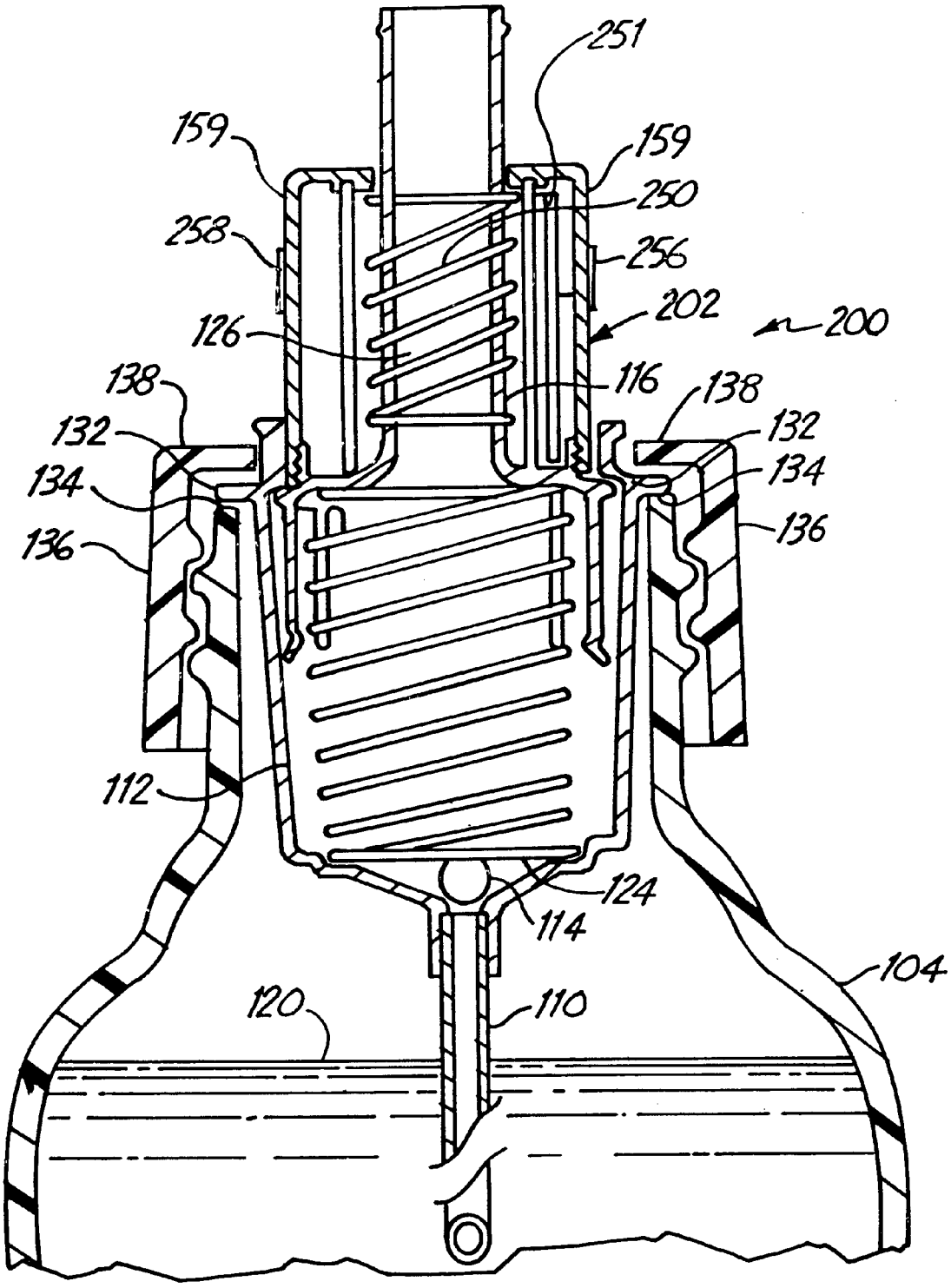
FIG. 2*b* is a fragmentary cross-sectional view of a second embodiment of the present heating and dispensing portion.

A second embodiment of the liquid heating assembly of this invention is depicted in FIG. 2*b* generally at 200. Liquid heating assembly 200 differs from the liquid heating assembly 100 mainly in that pump 202 includes a heating element 250 disposed externally to the plunger 116. The contacts 256 and 258 are disposed at similar locations as the contacts 156 and 158 described above. Of course, temperature sensors may be disposed either externally or internally within the plunger 116. Moreover, the heating element 250 may include a sensor mechanism to initiate and terminate heating of the liquid within the plunger 116. The contacts 256 and 258 are electrically connected to the heating element 250 by circuitry 251. If sensors are present, the circuitry may gauge the temperature difference between incoming and outgoing liquid and modulate the heating based on the temperature difference.

Figure 3:
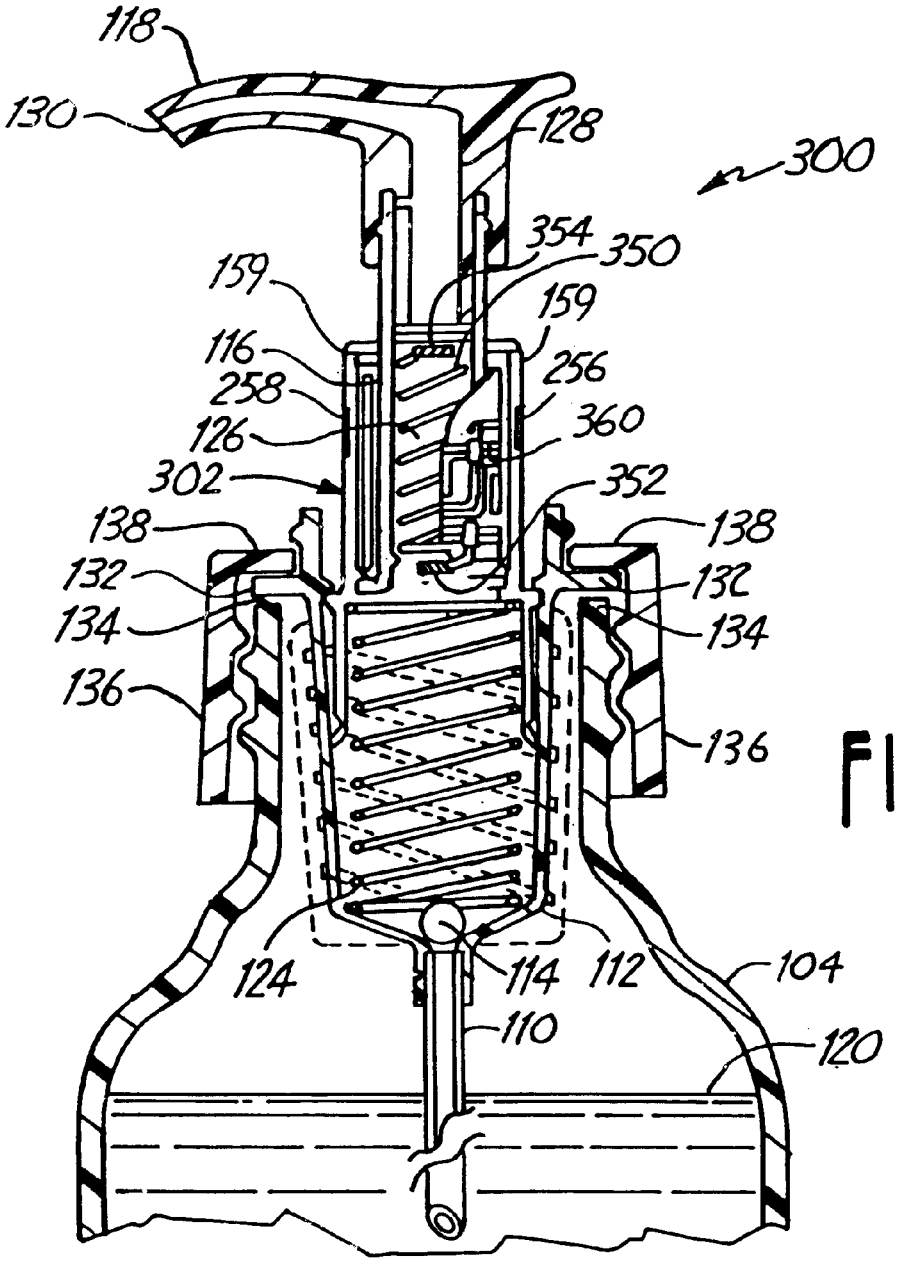
FIG. 3 is a fragmentary cross-sectional view of a third embodiment of the present heating and dispensing portion.

A third embodiment of the liquid heating assembly 300 is depicted in FIG. 3. Liquid heating assembly 300 differs from the above-described embodiments mainly in that the liquid pump mechanism 302 includes a heating element 350, temperature sensors 352 and 354, and circuitry 360. The heating element 350 is helically disposed about an interior surface of the plunger in this embodiment. The temperature sensors 352 and 354 and the internally disposed heating element 350 are in electrical communication with the circuitry 360. The circuitry 360 is further in electrical communication with the contacts 256 and 258. The temperature sensor 352 senses the temperature of liquid entering the plunger 116 and the sensor 354 senses the temperature of the liquid leaving the plunger 116. The circuitry 360 determines a temperature difference therebetween and controls the current to the heating element 350, to thereby moderate and more effectively control the amount of heat applied to the liquid within the plunger 116. The liquid is drawn from the container portion into the reservoir in a manner similar to that described above. From the heating reservoir, the liquid is drawn into the plunger and heated to the desired temperature. During pumping, the liquid may be rapidly heated before being dispensed due to the difference between sensings from the sensors 352 and 354.

Figure 4:
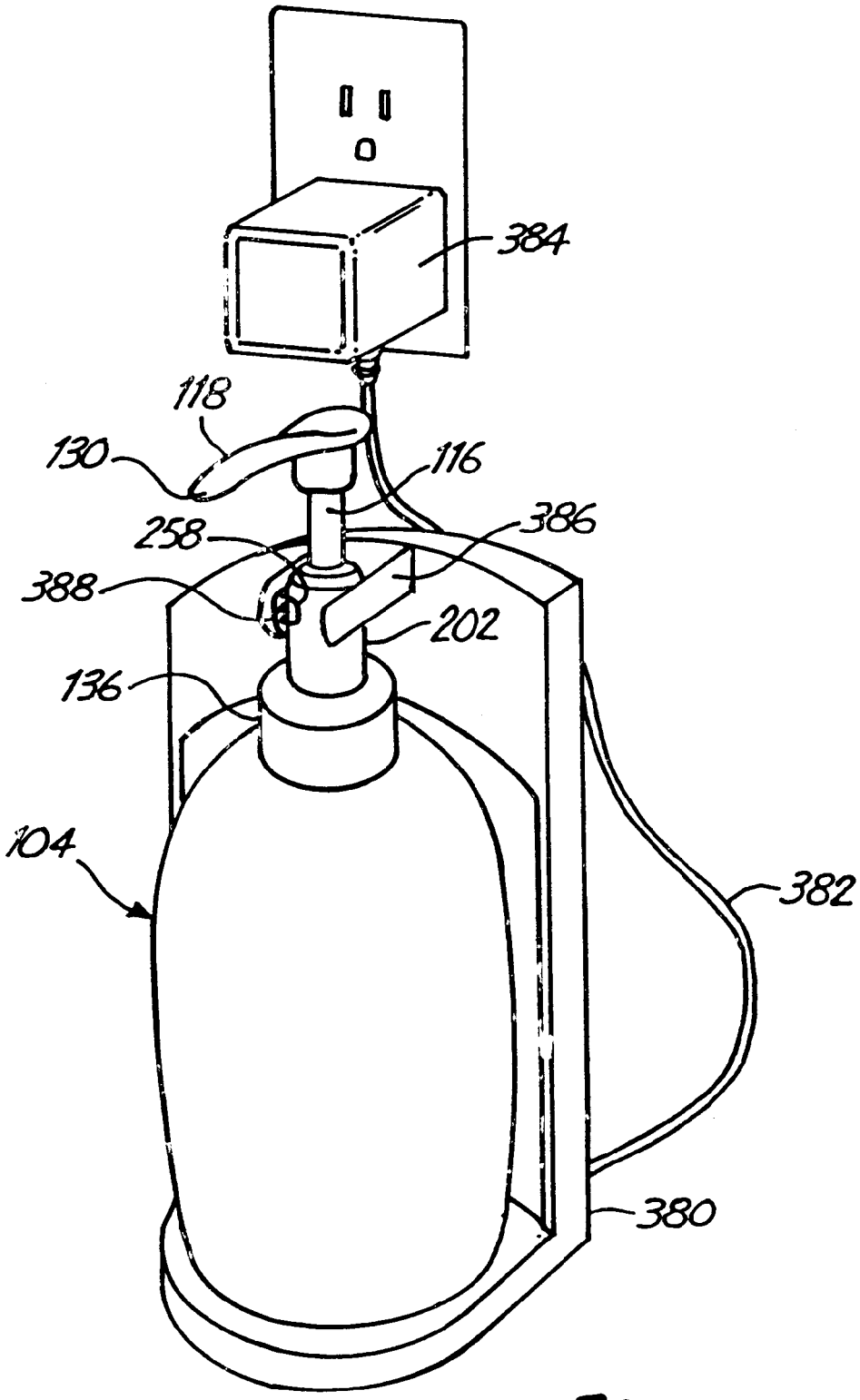
FIG. 4 is a perspective view of a first embodiment of the present heating and dispensing assembly.
Figure 5:
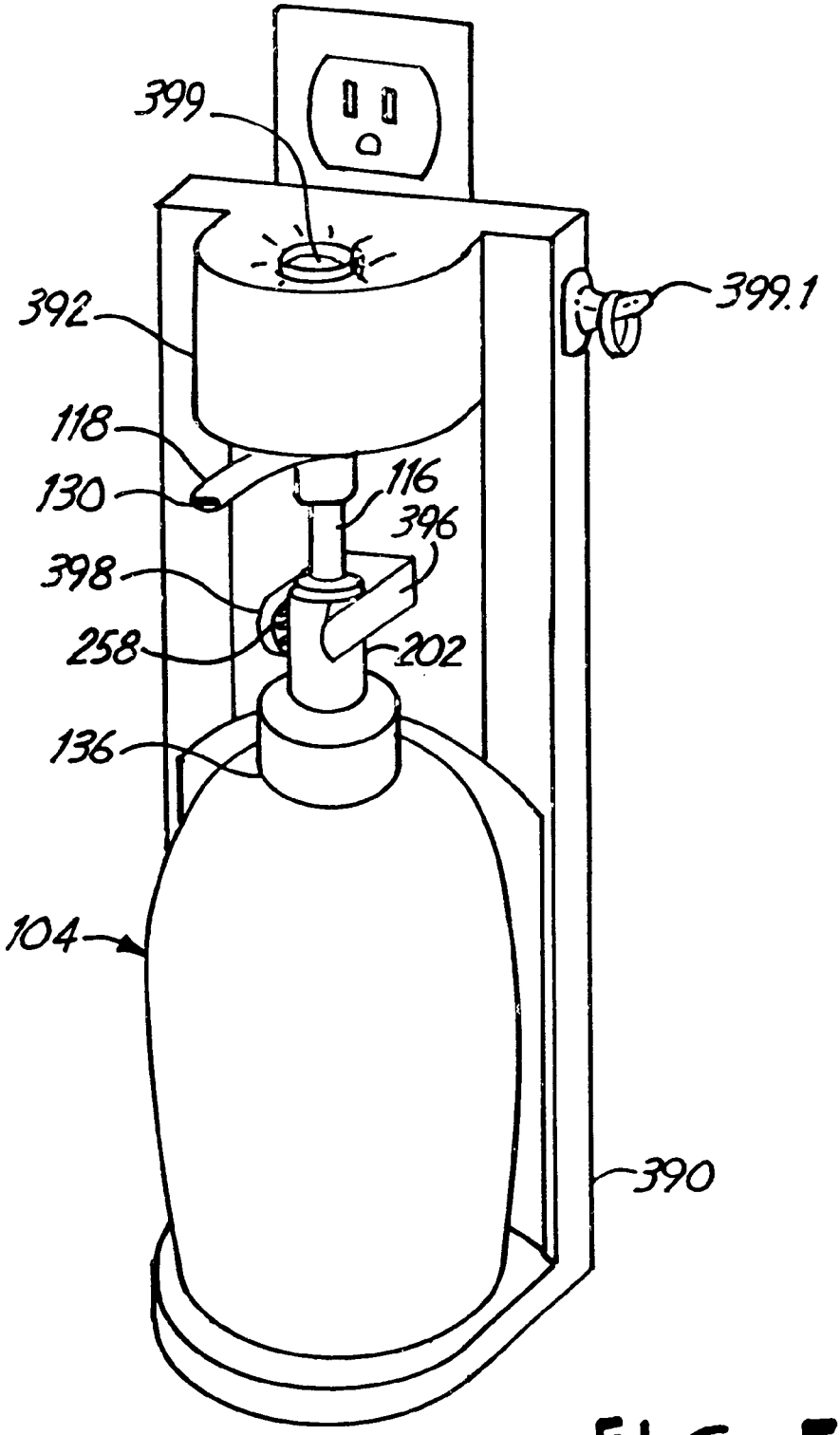
FIG. 5 is a perspective view of a second embodiment of the present heating and dispensing assembly.

FIGS. 4 and 5 further depict how the present invention may be configured to dispense heated liquids. In FIG. 4, the dispenser portion 202 and container portion 104 are disposed in a receiver configured as stand 380. An electrical cord extends between the stand 380 and a converter 384. The converter 384 converts household current, such as 117V AC, to a desired DC voltage. Also present is an electrical connection means configured as a bracket 386. A plurality of electrical contacts 388 are present on interior surfaces of the bracket 386 so as to contact electrical contacts 258 to convey electrical current to the pump 202. The electrical cord 382 conveys direct current from the converter 384 to each of the contacts 388.

Referring to FIG. 5, the pump 202 and container 104 are disposed in a stand receiver 390. A converter (not shown) is present in a stand housing 392. A bracket 396 includes electrical contacts 398. The electrical contacts 398 are disposed so as to contact electrical contacts 258 when the pump 202 and container 104 are in the position depicted in FIG. 5. The stand housing may form a storage configuration such as a ring holder 399.

Figure 6:
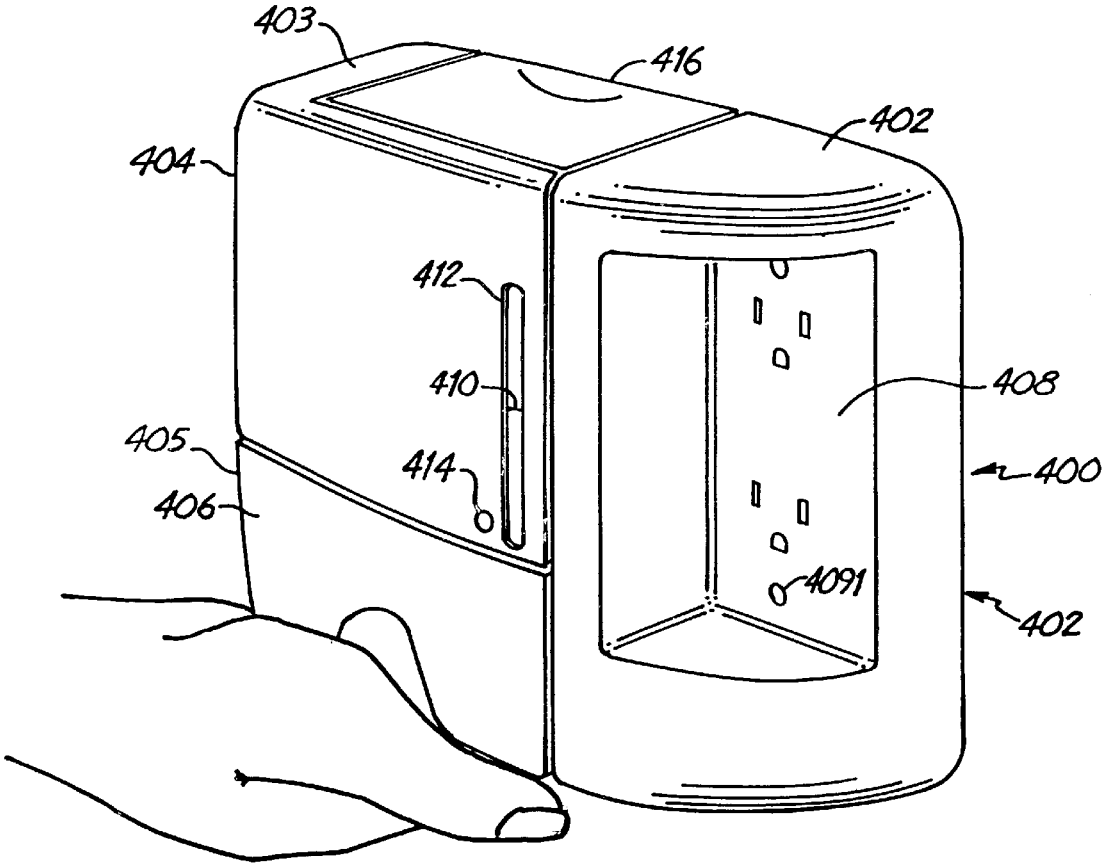
FIG. 6 is a perspective view of a third embodiment of the present heating and dispensing assembly.
Figure 7:
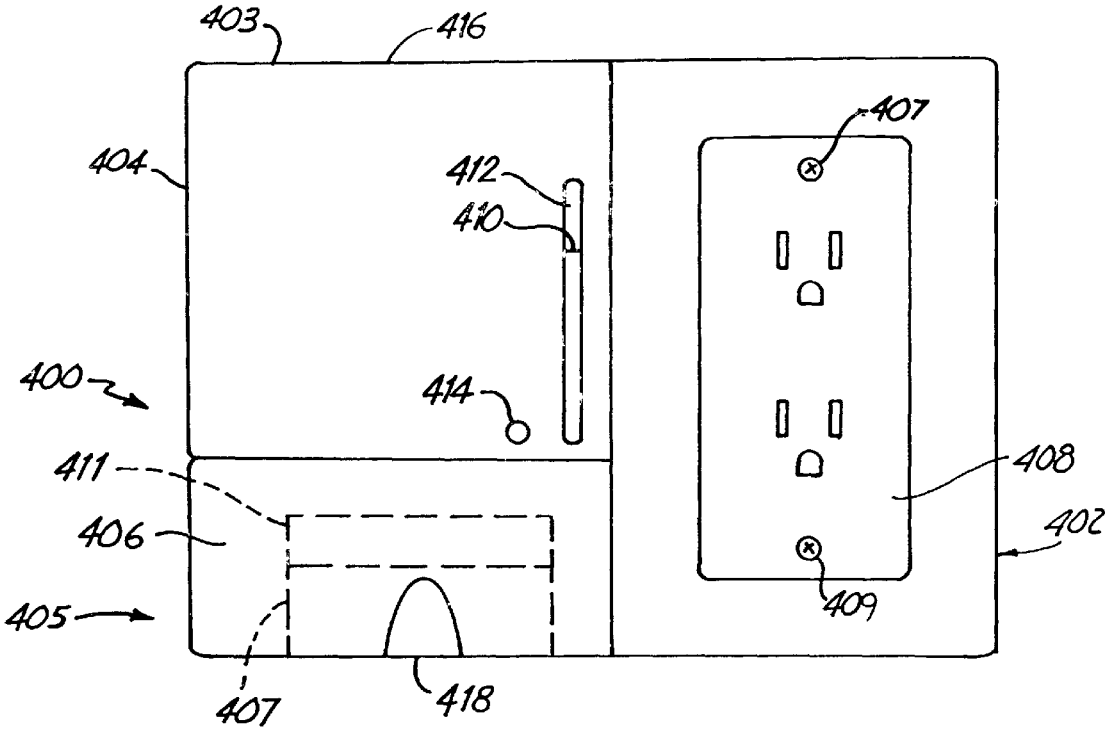
FIG. 7 is a front elevational view of the heating and dispensing assembly of FIG. 6.

Another embodiment 400 of the present invention for dispensing heated liquids is depicted in FIGS. 6 and 7 and includes a housing 402 and a main container portion 403 with a liquid reservoir 404. The system has a dispense portion 405 that includes a hinged or movable member 406. The movable member 406 operates an internal pump 407. The internal pump includes a pump mechanism reservoir 411 in which a portion of the liquid from the main reservoir 404 is heated prior to being dispensed, rather than heating all the liquid present in the main reservoir 404. Also present is an electrical plug-in 408. The electrical plug-in 408 is available to operate other appliances such as electric toothbrushes, hair dryers, and the like. The dispenser assembly 400 may be positioned so that electrical plug-in prongs in the rear of this embodiment (not shown) are plugged into a 110V outlet. Connectors, such as screws 409, may fix the dispenser assembly to the electrical outlet. A liquid level 410 is shown within a liquid level indicator 412. A heating indicator, such as a LED 414, may be present to indicate when the liquid is being heated in the pump reservoir. A converter (not shown) is present within the housing 402 to transform 110V AC to the desired DC voltage. An access door 416 allows the liquid chamber 404 to be refilled. The bottom edge of the movable member 406 is pivoted inwardly to dispense liquid from opening 418 in this embodiment.

Figure 8A:
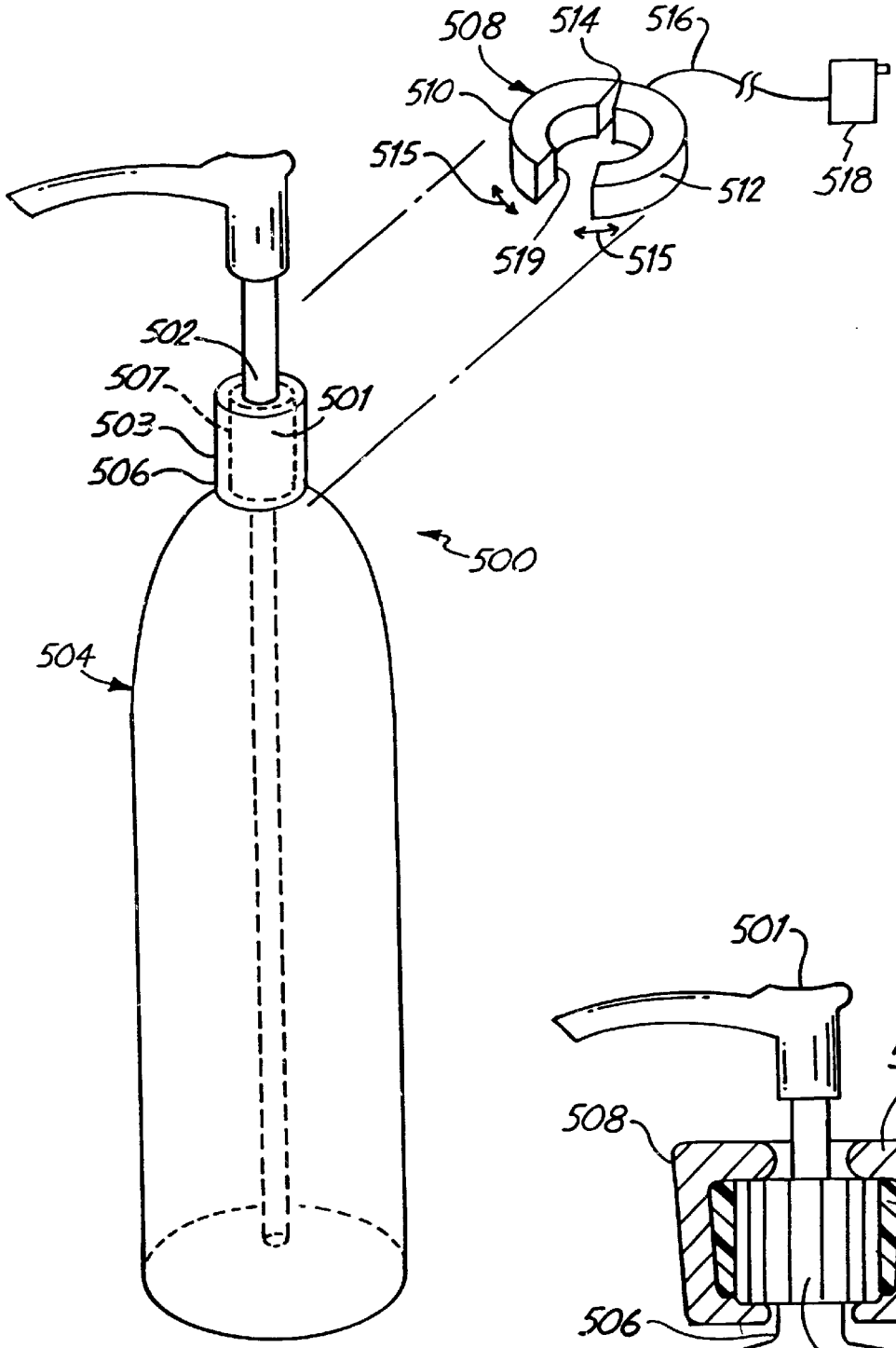
FIG. 8*a* is a perspective view of a fourth embodiment of the present heating and dispensing assembly.
Figure 8B:
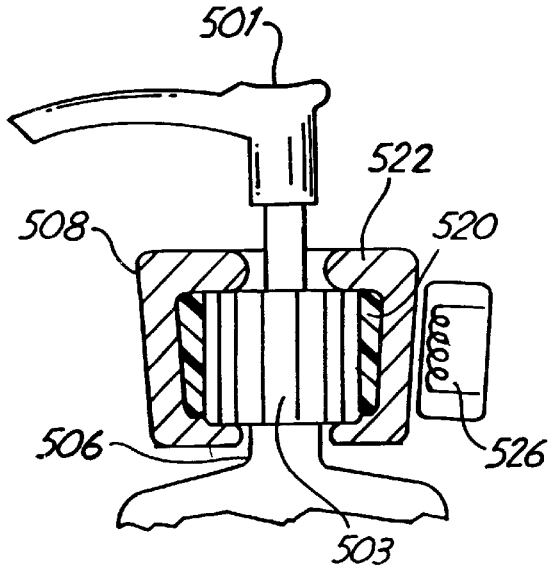
FIG. 8*b* is a cross section of an alternate embodiment of the heating assembly of FIG. 8*a;*

Additional embodiments of self-contained liquid dispenser 500 of the present invention is depicted in FIGS. 8*a* and 8*b*. A dispense portion 501 having a liquid pump mechanism 502 includes a nut 503. Also depicted is container 504 with a neck 506. A pump mechanism liquid reservoir 507 is disposed within the neck 506. A conductive heater 508 includes respective first and second halves 510 and 512, which may be joined by a hinge 514. The halves 510 and 512 pivot when being opened and closed as generally indicated by arrows 515. When closed, the conductive heater 508 is dimensioned to snugly accommodate the dispensing portion at the nut 503. A lead 516 connects the conductive heater 508 to a low voltage converter 518. Heat generating portion 519 is disposed within each first and second half 510 and 512 in this embodiment. Also present may be sensors, such as thermocouples and the like to actuate, discontinue, and/or modulate current to the heating elements, so as to heat the dispensing portion components and the liquid present therein to a desired temperature or within a desired temperature range. FIG. 8*b* represents an embodiment in which a heat generating portion 520 removably engages the dispensing portion and has a layer of insulative material 522 surrounding the heat generating portion. Power may be directly or inductively transferred to the heat generating element. The heat generating portion can remain on the self-contained dispensing unit while in use and when removed from an appropriate receiver and also may appropriately function as a heat storage element. The particular advantage of the embodiments of FIGS. 8*a* and 8*b* is that conventional and existing self-contained dispensing units may be utilized with the conductive heater portion 508.

Figure 9:
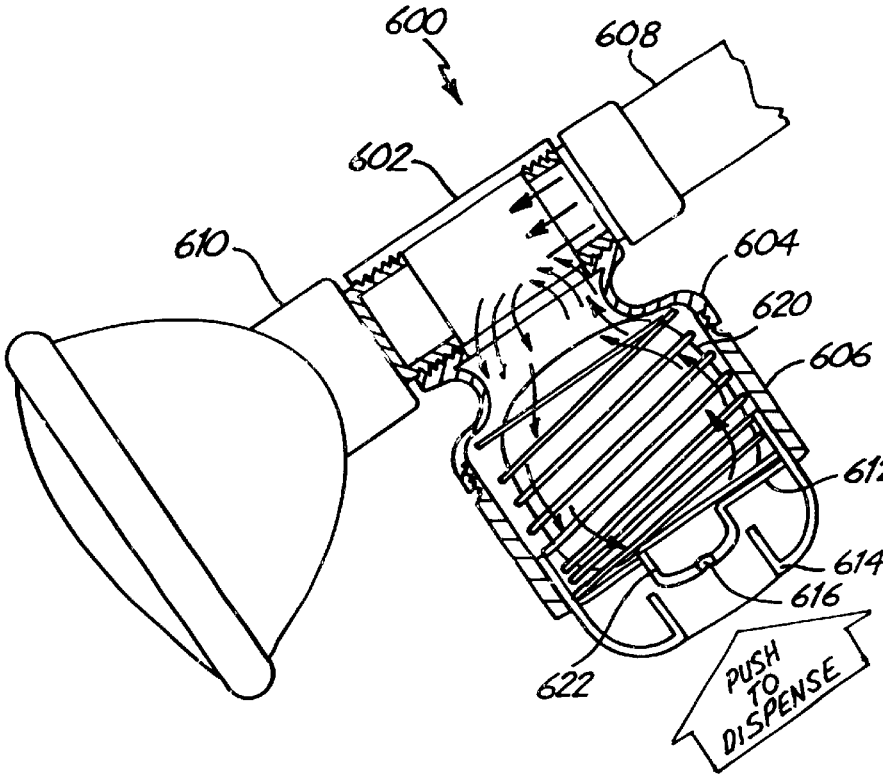
FIG. 9 is a side view of a fifth embodiment of the present heating and dispensing assembly.
Figure 10:
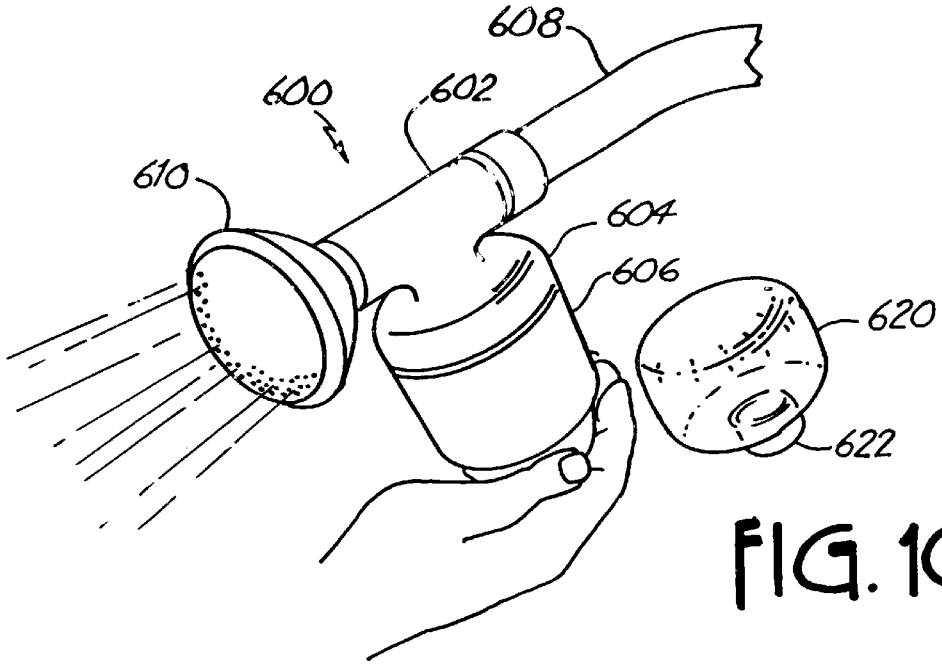
FIG. 10 is a perspective view of the heating and dispensing assembly of FIG. 9.

FIGS. 9 and 10 depict another embodiment of the present liquid warming assembly generally at 600. The liquid warming assembly 600 includes a fitting 602, a circulator 604 and a cap 606. The fitting 602 is configured to be installed so as to intercept a source of hot or warm water. In FIGS. 9 and 10, the liquid warming assembly 600 is installed between a shower pipe 608 and a shower head 610. The cap 606 threadably connects to the circulator 604 and includes a dispenser mechanism 612, which is accessible through a cap bottom opening 614. The dispenser mechanism 612 may be slidably disposed within the interior of the cap 606 and has a central orifice 616. The circulator 604 and cap 606 cooperate to accommodate a cartridge 620 therewithin. The cartridge 620 contains the liquid to be warmed by the warm or hot water. A cartridge extension 622 conforms to the portion of the dispenser mechanism 612 proximate the orifice 616. In one embodiment, at least a portion of the cartridge 620 is flexible or pliable. When the cartridge 620 is installed within the liquid warming assembly 600, warm water is diverted and circulates in spaces defined between the circulator 604, cap 606, and cartridge 620 as depicted by the arrows in FIG. 9. When the liquid therewithin has been heated, the lotion is dispensed by pressing the dispenser mechanism 612 until the warm liquid is forced through the orifice 616 (FIG. 10).

Figure 11:
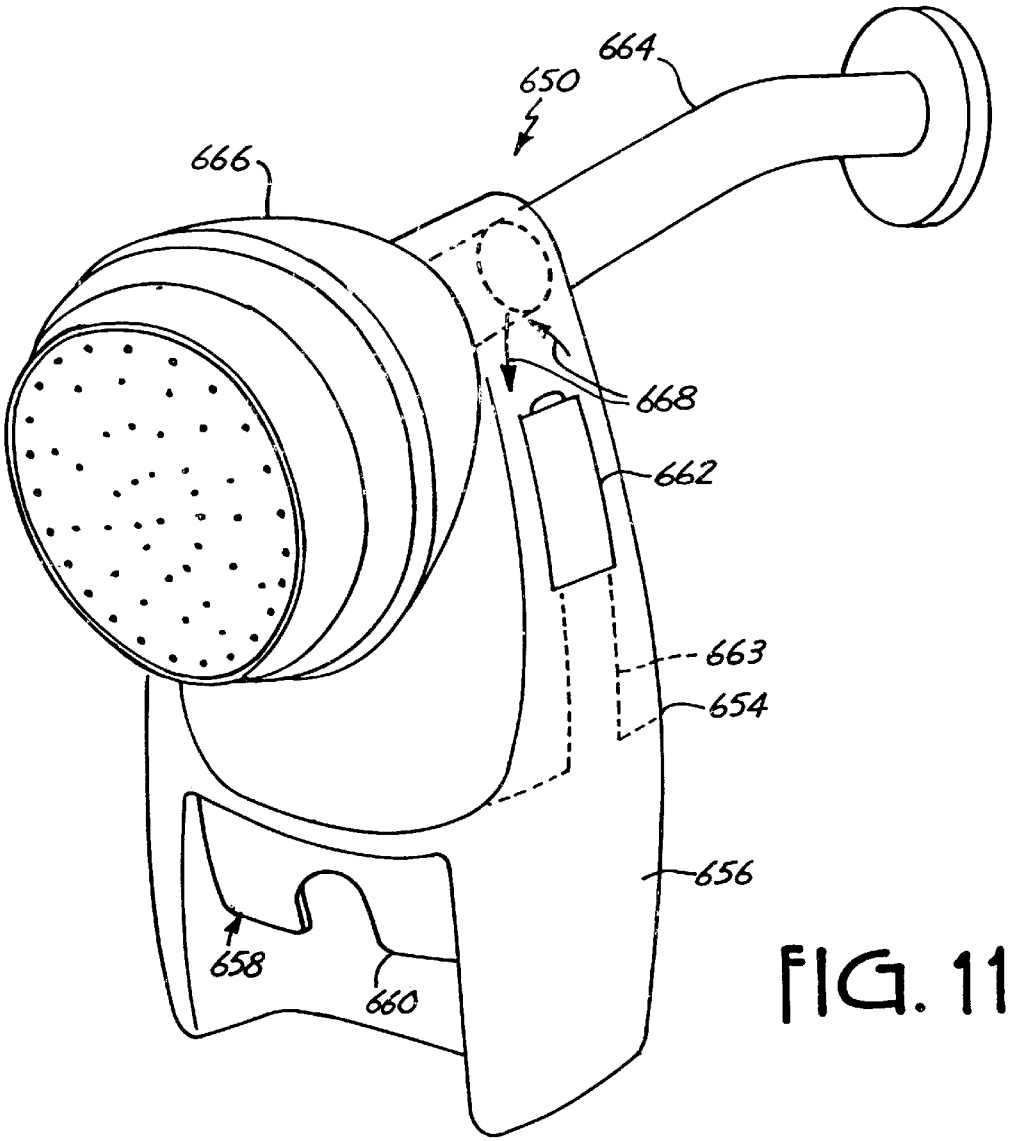
FIG. 11 is a perspective view of a sixth embodiment of the present heating and dispensing assembly.
Figure 12:
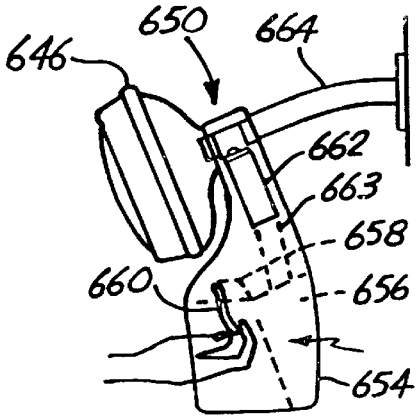
FIG. 12 is a side view of the heating and dispensing assembly of FIG. 11, depicting the pump mechanism and reservoir in phantom.

Another embodiment of the liquid warming assembly is depicted in FIGS. 11 and 12 and indicated generally at 650. The liquid warming and dispensing assembly 650 includes a body 654. The body 654 defines a reservoir 656 and houses a dispensing pump 658 and dispensing handle 660. An access panel 662 can be removed to refill the reservoir 656 as desired. A tube 663 extends between the access covered by the access panel 662 and the remainder of the reservoir 656. The body 654 intercepts a source of hot water, and circulates the hot water above the pump reservoir to heat the liquid within as shown by arrows 668 in FIG. 11. The body 654 is threaded onto the shower pipe 664 and the shower head 666 is threaded into the body 654. An alternative embodiment would utilize a highly thermal conductive material that is a non-fluid conductive as the element at 663 to warm the fluid.

Figure 13:
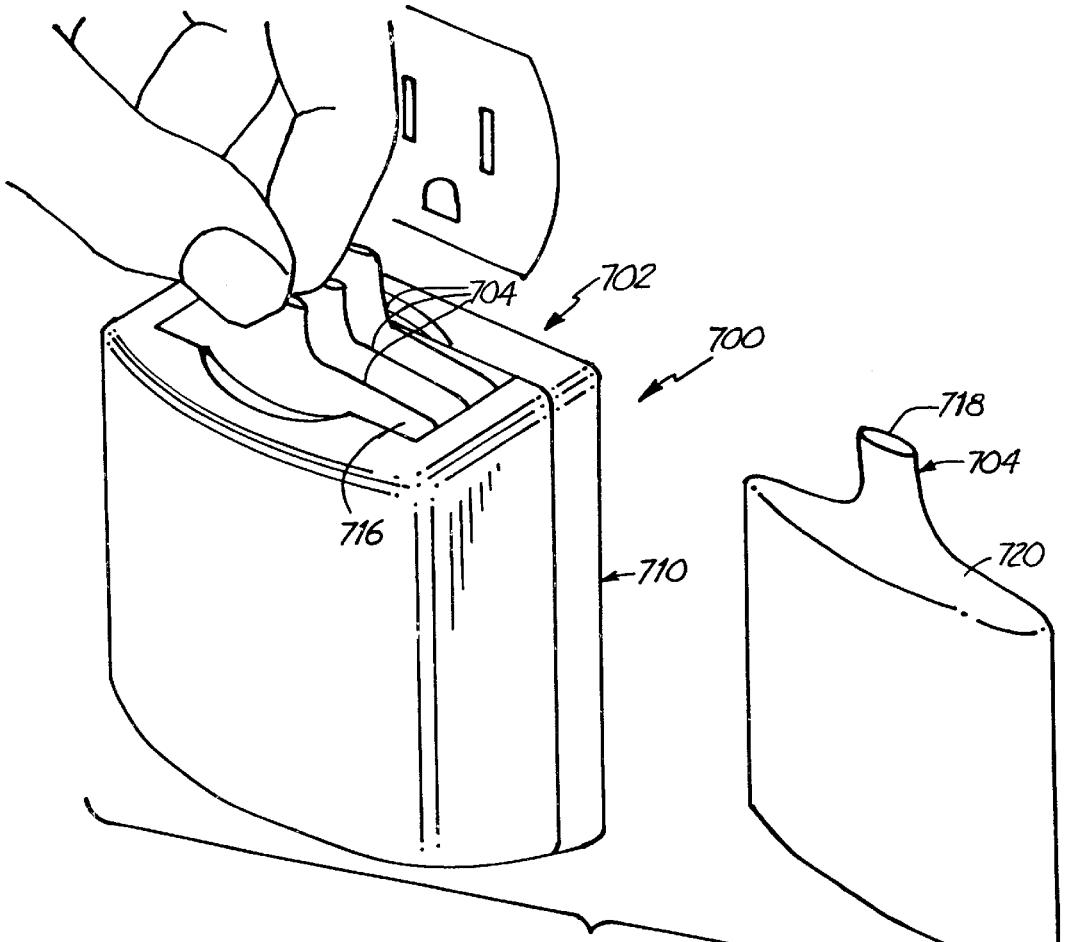
FIG. 13 is a perspective view of a seventh embodiment of the present heating and dispensing assembly.
Figure 14:
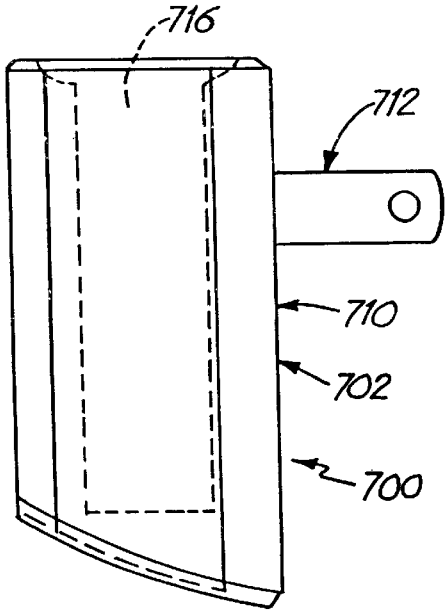
FIG. 14 is a side view of the heating and dispensing assembly of FIG. 13, depicting the packet compartment in phantom.

Another embodiment of this invention is shown in FIGS. 13 and 14 at 700 and includes a warmer-holder 702, which warms and holds packets 704. The warmer-holder 702 includes a heater assembly 710, to which is provided electrical power by a plug-in 712. The heater assembly 710 may include a converter and one or more temperature sensors to initiate heating and to maintain the packets 704 at a desired temperature and is located around a compartment 716 in this embodiment. The exemplary compartment 716 holds three packets 704 for heating until the packets are dispensed as shown in FIG. 13. Some packets may include a section 718, which is easily separated from the body 720 of the packet so that the liquid within the packet 704 can be used. The warmer holder 702 is connected to an electrical source as depicted in FIG. 13 and the packets 704 are warmed to, and maintained at, a desired temperature. The packets 704 are removed when the liquid therewithin is needed. These packets can then be replaced, the unheated replacement packets being warmed to the desired temperature and available for use.

Figure 15:
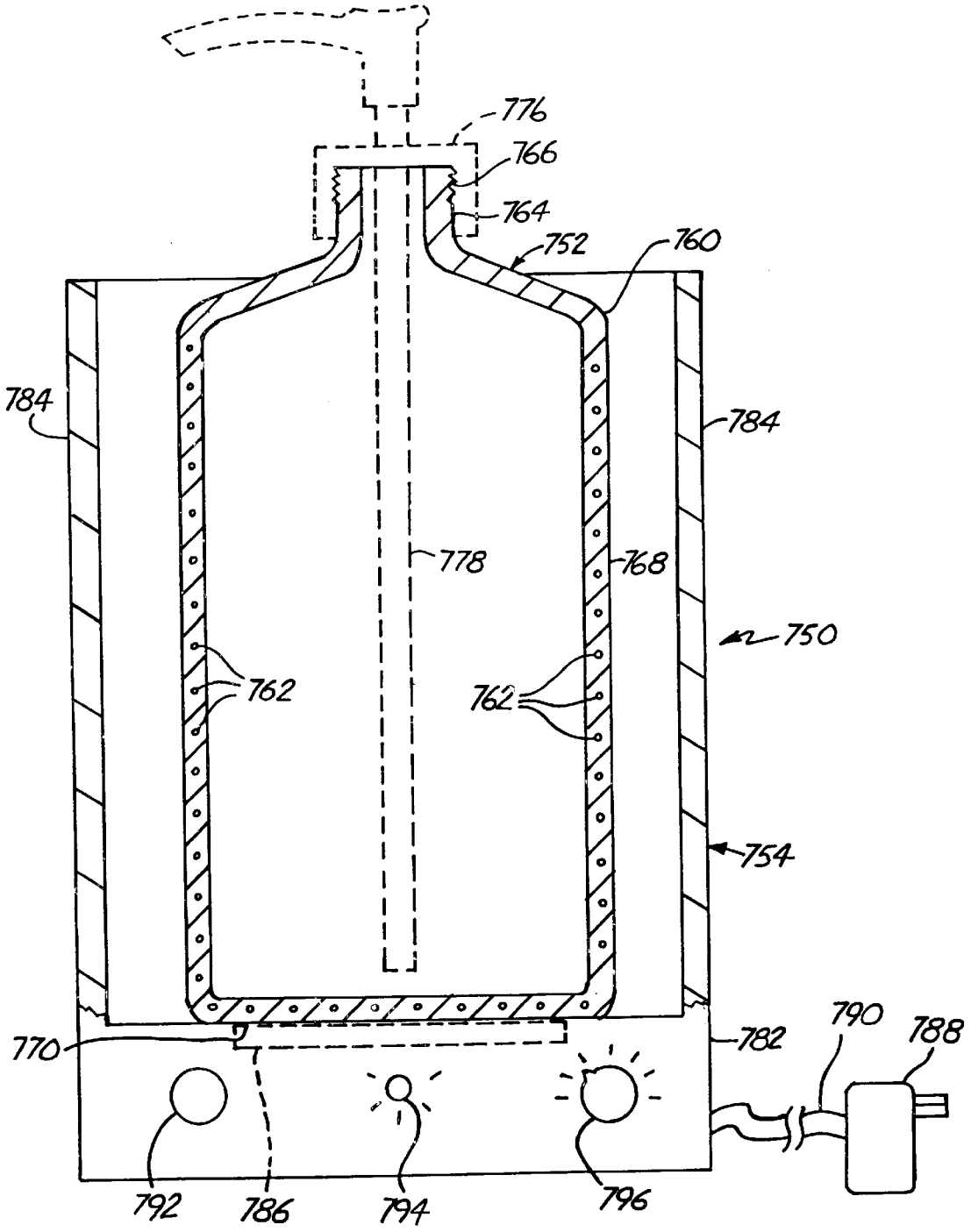
FIG. 15 is a front view of an eighth embodiment of the present heating and dispensing assembly, depicting a cutaway portion of the holder.

FIG. 15 depicts yet another embodiment of the present liquid heating assembly at 750. The liquid heating assembly 750 includes a container 752 and a holder 754. The container 752 may be made from an electrically insulative material 760 and a heating coil 762. However, the heating coil may be wrapped by an insulator as well. The exemplary container 752 tapers to a neck portion 764. Threads 766 are formed in an upper portion of the neck 764. The container 752 further includes respective body and base portions 768 and 770. In this embodiment, the heating coil 762 winds around the body and base portions and may include a power transfer coil in the container base. A dispenser pump 776 is depicted in phantom threaded onto the neck 764, a draw tube 778 extending from the pump 776 into the container.

The holder 754 includes a base 782 and an optional sidewall 784. Present in the base is an electrical connection means (or connector) 786 (depicted in phantom). The electrical connection means 786 transmits electrical current to the heating coil and is contemplated to include embodiments transmitting electrical current by direct contact, conductive coupling, a power transfer coil, or the like. The connection means 786 receives electric current from a converter 788 via an electrical cord 790. The converter 788 converts household AC current into a desired DC voltage current. Also present in the base are control switches and indicators, such as an ON/OFF switch 792, a READY light 794, and an adjustment dial 796. In this embodiment, the ON/OFF switch 792 toggles to connect or disconnect current to the connection means 786. The READY light 794 illuminates when current is flowing to the connection means. The amount of current, hence the temperature of the liquid within the container 752, is controlled by the adjustment dial 796. The dial 796 may also set a thermocouple or other temperature control mechanism as well.

Figure 16:
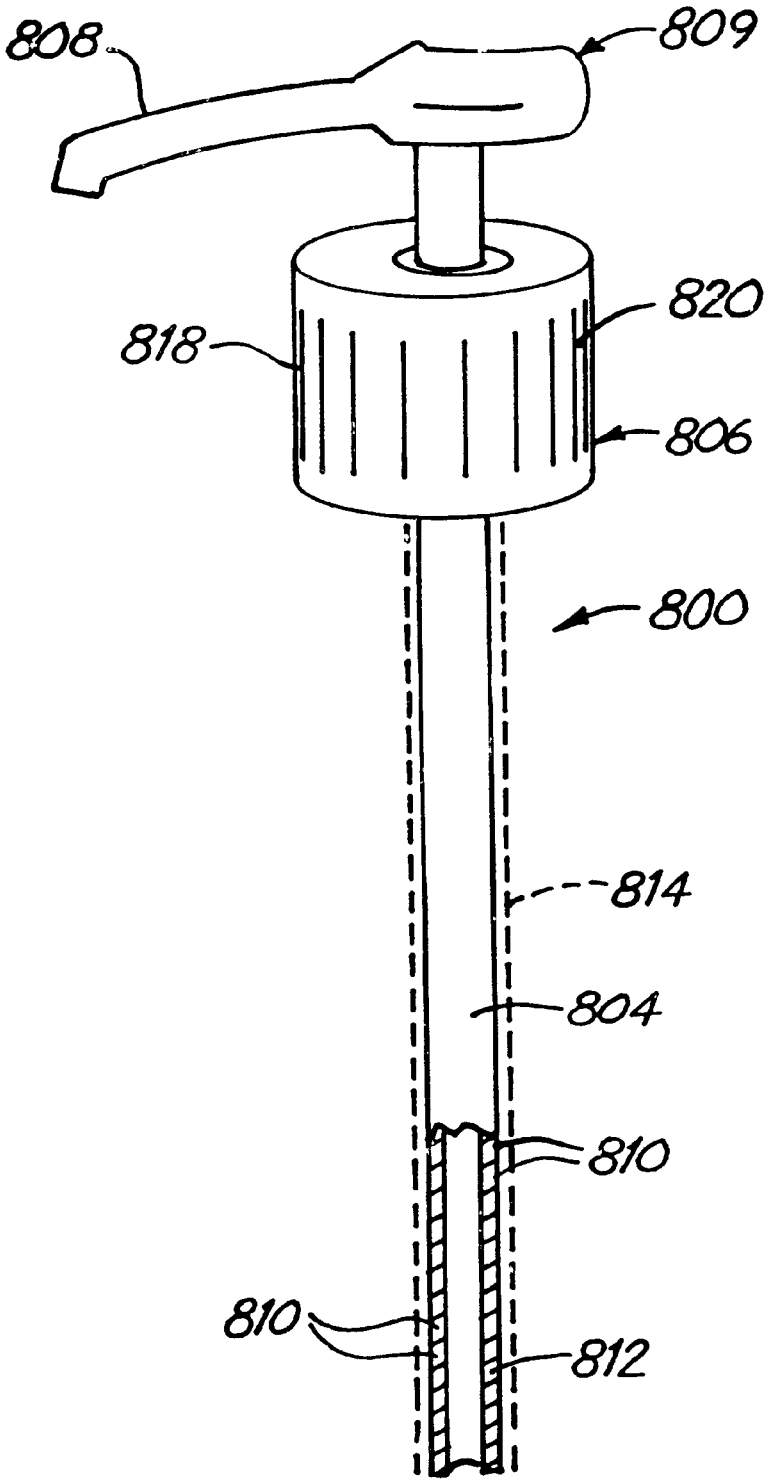
FIG. 16 is a perspective view of a eighth embodiment of the present heating and dispensing assembly.

Another embodiment of a dispense portion 800 in accordance with the invention is depicted in FIG. 16. The dispense portion 800 includes a draw tube 804, a cap 806, a spout 808 and a pump handle 809. This embodiment differs from the embodiments discussed above mainly in that heating wires 810 are embedded in the draw tube 804. The draw tube 804 may be of an electrically insulative material or the heating wires may be enclosed by an electrically insulating material. An optional heat insulative material 814 (depicted in phantom) may extend around all or a portion of the draw tube 804. The connectors 818 and 820 are in electrical communication with, and provide electrical current to, the heating wires 810 in this embodiment. The connectors 818 and 820 may receive electric current, e.g., by direct contact or inductive coupling, from any of the converters discussed above. Moreover, temperature sensors such as those discussed above may also be present.

Because numerous modifications of this invention may be made without departing from its spirit, the scope of the invention is not to be limited to the embodiments illustrated and described. Rather, the scope of the invention is to be determined by the appended claims and their equivalents.

What is claimed is:

1. A portable liquid heating system for heating and dispensing a liquid, the system comprising:

a self-contained dispensing unit comprising:

a container portion with a main liquid reservoir for holding a supply of the liquid to be dispensed and a neck portion with an opening;

a dispensing portion having a down tube with a flow conduit, a manually operated pump mechanism connected to the down tube, and an outlet spout connected to the pump mechanism, the pump mechanism having a pump mechanism liquid reservoir, whereby liquid in the main reservoir of the container portion is received by the down tube and pumped into the pump mechanism liquid reservoir and out of the outlet spout; and an electric heat generating portion positioned at the dispensing portion, whereby liquid pumped out of the main reservoir is heated before being dispensed through the outlet spout;

a receiver for accepting the self-contained dispensing unit, the receiver providing a power source removably connectable to the electric heat generating portion; and wherein the receiver further provides presence sensing means, whereby when the self-contained dispense unit is not positioned in the receiver, power to the coil in the receiver is at least reduced.

2. The portable liquid heating system of claim 1, wherein the receiver and the electric heat generating portion each comprise at least one metallic contact, said metallic contacts conducting electricity from the receiver to the electric heat generating portion.

3. The portable liquid heating system of claim 1, wherein the receiver and the electric heat generating portion comprise a pair of power transfer coils, one of said power transfer coils located in the receiver and one located in the electric heat generating portion.

4. The portable liquid heating system of claim 1, wherein the pump mechanism is comprised of a cylinder and a piston, and wherein said cylinder and piston define the pump mechanism liquid reservoir, and wherein the heat generating element contacts the liquid in said pump mechanism liquid reservoir.

5. The portable liquid heating system of claim 1, wherein the receiver is configured as a stand that supports the self-contained dispensing unit.

6. The portable liquid heating system of claim 1, further comprising a temperature control for reducing the power to the heating portion when a predetermined temperature is reached by liquid in the dispensing portion.

7. The portable liquid heating system of claim 1, wherein the heat generating portion is positioned at said pump mechanism reservoir.

8. The portable liquid heating system of claim 7, wherein the pump mechanism comprises a cylinder and a manually operated piston, said piston and cylinder defining the liquid reservoir, and wherein the heat generating portion is positioned in said reservoir.

9. The portable liquid heating system of claim 1, wherein the heat generating portion removably couples with the exterior of the receiver.

10. A portable liquid heating system for heating and dispensing a liquid, the system comprising:

a self-contained dispensing unit comprising:

a container portion with a main liquid reservoir for holding a supply of the liquid to be dispensed and a neck portion with an opening;

a dispensing portion having a down tube with a flow conduit, a manually operated pump mechanism connected to the down tube, and an outlet spout connected to the pump mechanism, the pump mechanism having a pump mechanism liquid reservoir, whereby liquid in the main reservoir of the container portion is received by the down tube and pumped into the pump mechanism liquid reservoir and out of the outlet spout; and an electric heat generating portion positioned at the dispensing portion, whereby liquid pumped out of the main reservoir is heated before being dispensed through the outlet spout;

a receiver for accepting the self-contained dispensing unit, the receiver providing a power source removably connectable to the electric heat generating portion; and a timer to discontinue providing power to the self-contained dispensing unit after said unit has not been removed from the receiver for a predetermined period of time.

11. A portable liquid heating system for heating and dispensing a liquid, the system comprising:

a self-contained dispensing unit comprising:

a container portion with a main liquid reservoir for holding a supply of the liquid to be dispensed and a neck portion with an opening;

a dispensing portion having a down tube with a flow conduit, a manually operated pump mechanism connected to the down tube, and an outlet spout connected to the pump mechanism, the pump mechanism having a pump mechanism liquid reservoir, whereby liquid in the main reservoir of the container portion is received by the down tube and pumped into the pump mechanism liquid reservoir and out of the outlet spout; and an electric heat generating portion positioned at the dispensing portion, whereby liquid pumped out of the main reservoir is heated before being dispensed through the outlet spout;

a receiver for accepting the self-contained dispensing unit, the receiver providing a power source removably connectable to the electric heat generating portion; and a timer to discontinue providing power to the self-contained dispensing unit after the system has not been manually contacted for a predetermined period of time.

* * * * *